US005687488A

United States Patent [19]

Araújo De Sousa

[11] Patent Number: 5,687,488

[45] Date of Patent: Nov. 18, 1997

[54] GAUGE FOR PREPARATION OF DRAWINGS WITH VIRTUAL DEEPNESS EFFECT ACHIEVEMENT AND METHOD FOR USING THEREOF

[76] Inventor: Mauricio Araújo De Sousa, Av. Professor Fonseca Rodrigues, 520 - Pinheiros, Sãn Paulo - SP, Brazil, 05461-010

[21] Appl. No.: 432,012

[22] Filed: May 1, 1995

[30] Foreign Application Priority Data

Jan. 5, 1995 [BR] Brazil ..... 9500111-5

[51] Int. Cl.[6] ..... B43L 13/20

[52] U.S. Cl. ..... 33/565; 33/20.4

[58] Field of Search ..... 33/563, 565, 20.4; 395/119; 351/203, 240; 359/462

[56] References Cited

U.S. PATENT DOCUMENTS

| | | | |
|---|---|---|---|
| 4,135,502 | 1/1979 | Peck | 351/203 |
| 4,986,652 | 1/1991 | Mogilevsky et al. | 33/20.4 |
| 5,058,285 | 10/1991 | Morita et al. | 33/565 |

FOREIGN PATENT DOCUMENTS

| | | | |
|---|---|---|---|
| 959591 | 3/1957 | Germany | 359/462 |
| 2950733 | 2/1981 | Germany | 33/565 |
| 2260421 | 4/1993 | United Kingdom | 359/462 |
| 2261853 | 6/1993 | United Kingdom | 33/563 |
| 82/02023 | 6/1982 | WIPO | 33/565 |

*Primary Examiner*—Thomas B. Will
*Attorney, Agent, or Firm*—Darby & Darby

[57] ABSTRACT

A gauge for preparing drawings and/or other characters which are observed in such a way to achieve a virtual deepness effect, and a method for using the gauge in which that gauge has a base part (1) of with stencil type cutouts of letters (2) and/or graphic elements (3) and/or semi or totally pre-formed drawings (4), to serve as patterns for the drawing reproduction on a determined surface, and the base part has a scale with markings at progressively closer distance intervals (m). The gauge is positioned on a drawing surface, a figure is drawn through a cutout at a marked point on the surface, the gauge is moved to the marked point, the figure is redrawn and a point of smaller distance is marked. The redrawing is continued as many times as desired.

4 Claims, 5 Drawing Sheets

GAUGE FOR PREPARATION OF DRAWINGS WITH VIRTUAL DEEPNESS EFFECT ACHIEVEMENT AND METHOD FOR USING THEREOF

RELATED APPLICATIONS

Subject matter related to this invention is disclosed in each of applications "Process for the Production of Drawings for Virtual Deepness Effect" (Attorney/Docket No. 0708/0B051) and "Process for the Production of Drawings for Virtual Approach Observation" (Attorney/Docket No. 0708/0B052), of the same inventor, filed concurrently herewith and incorporated by reference.

FIELD OF THE INVENTION

The present invention refers to a gauge for preparing drawings and/or other characters which are observed in a way to achieve a virtual deepness effect, as well as a method for using the gauge.

More specifically, the present invention refers to a gauge specially adequate for the preparation of drawings of cartoon characters and other indicia from which it is possible to achieve a virtual deepness effect.

BACKGROUND OF THE INVENTION

To provide a better understanding of the present invention, a brief explanation about the basic concepts applied for its development, taken on a more general understanding of human optics, is provided.

The existence of different deepness levels in space is perceived when the brain joins the images registered by the pair of eyes of a human subject.

The image received at each eye has a small difference from the one received by the other eye, which determines the distance of the object with relation to the point of view (deepness).

Accordingly, similar drawings, disposed in a horizontal line on a surface, such as a piece of paper, and with different distances between each other, when seen with the eyes focused in front or back of the paper, appear to be in different deepness levels.

Focusing at a more distant point, beyond the paper surface, the smaller that the distance among the drawings actually is and the closer they will seem. By making the focus of the eyes in front of the paper, the opposite occurs.

The first way described, that is, the focus of the eyes back of the paper, is hereafter called the "parallel" vision way, since the idea is to see the left figure using the left eye and the right figure using the right eye (keeping the two eyes vision axis almost parallel), until the brain resolves the two images into a single one.

The other way, having the focus in front of the paper, consists of observing the right figure using the left eye and the left figure using the right eye, until the two images are overlaid. This amounts to crossing the vision axis of each of the two eyes.

These two vision ways have variations, which are various possible focus levels.

It is easier to "cross" the vision axis ("cross" the eyes) than "open" said axis. A person is able to look at his or her nose tip, but cannot look simultaneously at two objects which are at a distance greater than the distance between the eyes, unless they are too far. This establishes a parameter in aiming for a specific result for the "parallel" vision way, that the distance between the figures should not be greater than the distance that separates the eyes of a subject.

Considering that the average reading distance between the eyes and the paper is approximately 25 cm, it is suitable that the distance between the figures is not greater than 45 mm, because beyond this distance it is necessary to move the focus of the eyes out of the paper in order to achieve the effect.

Equal size drawings disposed side by side, and having different distances between them, make them seem to be on different deepness planes when they are seen through one of these vision ways, while slightly modified drawings may produce different results. An example of the latter is two triangles drawn side by side, the left one being equilateral and the right one isosceles, and having the same height. By using the parallel vision way, the right side of the virtual triangle (which is formed between both of them) seems to be closer than the left side. By changing the positions, the effect is inverted.

Besides these aforementioned effects, it should be considered that the deepness perception is due to the images fusion registered by the two eyes of a subject, which are different, since each of the eyes occupies a different point in space.

It is possible to simulate the deepness sensation in various ways, for example, "deceiving" the brain, relative to one or more drawings disposed side by side.

There are two basic ways of viewing in order to perceive the desired deepness effect; by locating the focus beyond the paper, the two eyes vision axis being convergent ("parallel" mode), or by focusing in front of the paper, the axis being divergent ("crossed" mode). These two ways also present variations, which are the various possible focus levels. In general, the effect achieved in one way corresponds to the opposite in the other way. If in the "parallel" mode, a figure seems to be closer, in the "crossed" mode it will seem to be more distant.

Equal size figures disposed side by side may simulate appearance in different planes, depending on the distance between the figures. In the "parallel" vision mode, the smaller the distances, the closer the figures will seem, while in the "crossed" vision mode the opposite occurs.

Similar figures (having small differences among each other), and side by side, cause a continuous deepness sensation, not divided in separate planes, in case they are under or over other alignments, which may have any kind of difference between each other.

BRIEF DESCRIPTION OF THE DRAWINGS

The gauge of the present invention will now be described with reference to the attached figures, wherein.

DETAILED DESCRIPTION OF THE INVENTION

Figure 1:
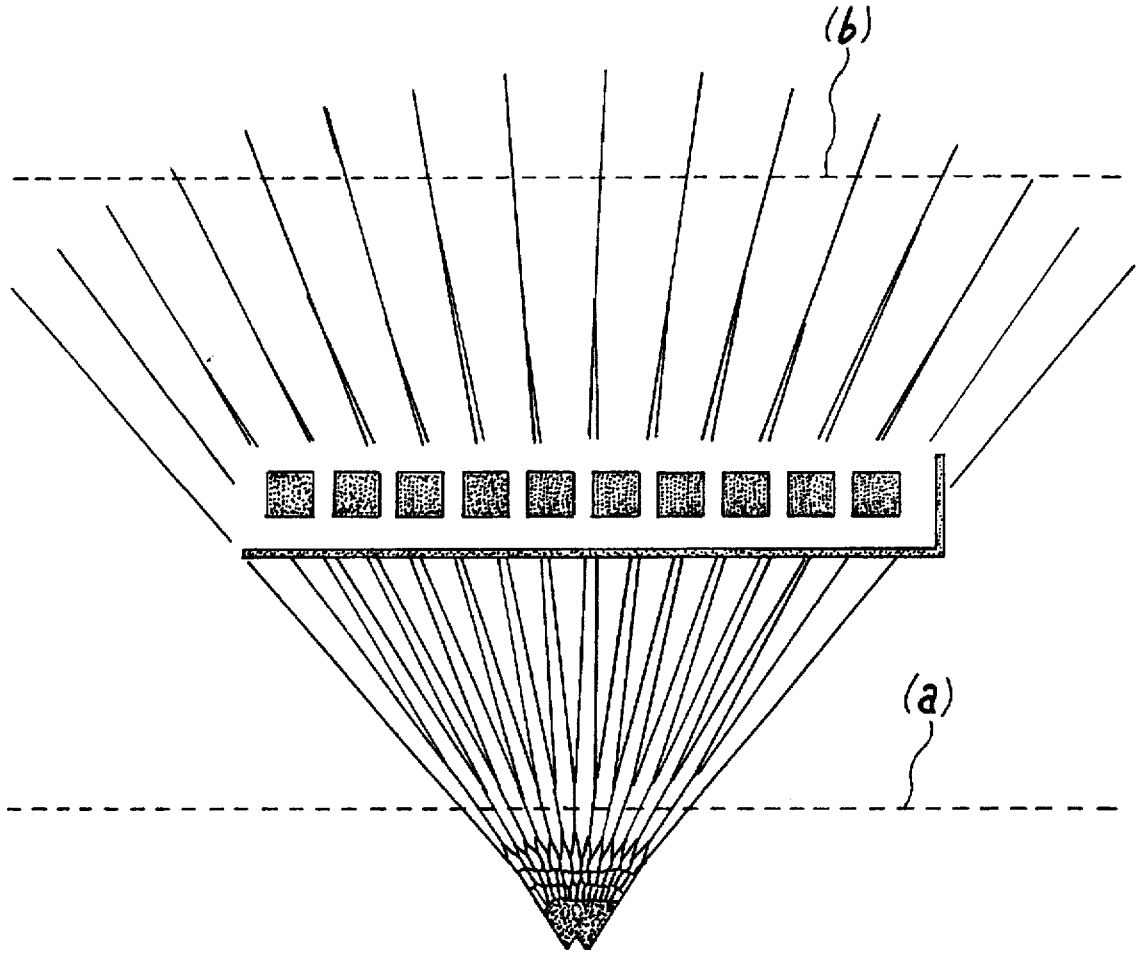
FIG. 1 is a diagram showing two possible vision focus levels.

FIG. 1 shows how similar drawings, which are horizontally disposed and have differing distances between them, can be viewed. Line (a) represents the line of the first focus, wherein the figures "unite" sequentially and line (b) represents the alternative line of the second focus, wherein the figures "unite".

Figure 2A:
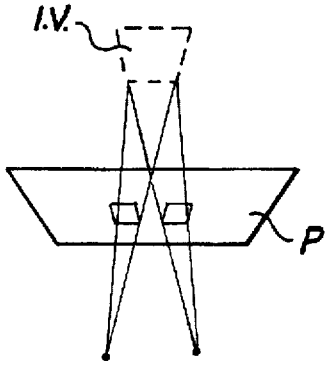
FIGS. 2*a* and 2*b* show virtual image achievement schemes.
Figure 2B:
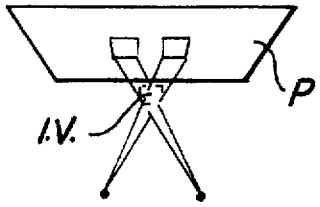

FIGS. 2*a* and 2*b* show a result achieved by the two ways of looking at the drawings, as described above. FIG. 2*a* shows the virtual image formation (V.I.) behind plane (P), according to the "parallel" vision way, and FIG. 2*b* shows focus in front of plane (P) at I.V. according to the "crossed" vision way, respectively.

Figure 3A:
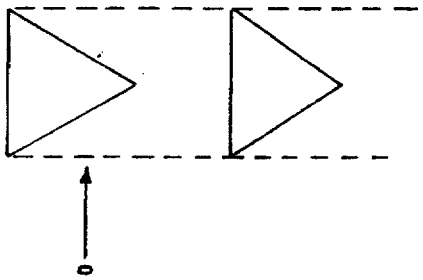
FIGS. 3*a* and 3*b* show an example of achieving different results in the image, from an equilateral triangle (left) and an isosceles triangle (right) drawn side by side.
Figure 3B:
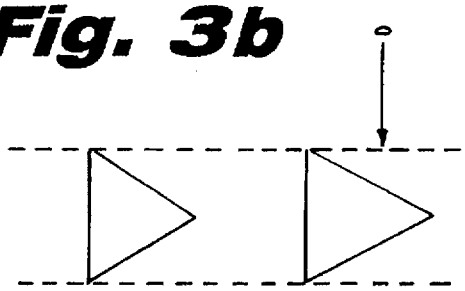

FIGS. 3*a* and 3*b* demonstrate the achievement of different results from slightly modified drawings. Notice that in FIG. 3*a*, through the parallel vision way, the right side of the triangle in virtual image (third one to appear), for the viewer seems to be closer. By observing the opposite side, the opposite occurs, that is, the left side for the viewer seems to be closer.

Figure 4:
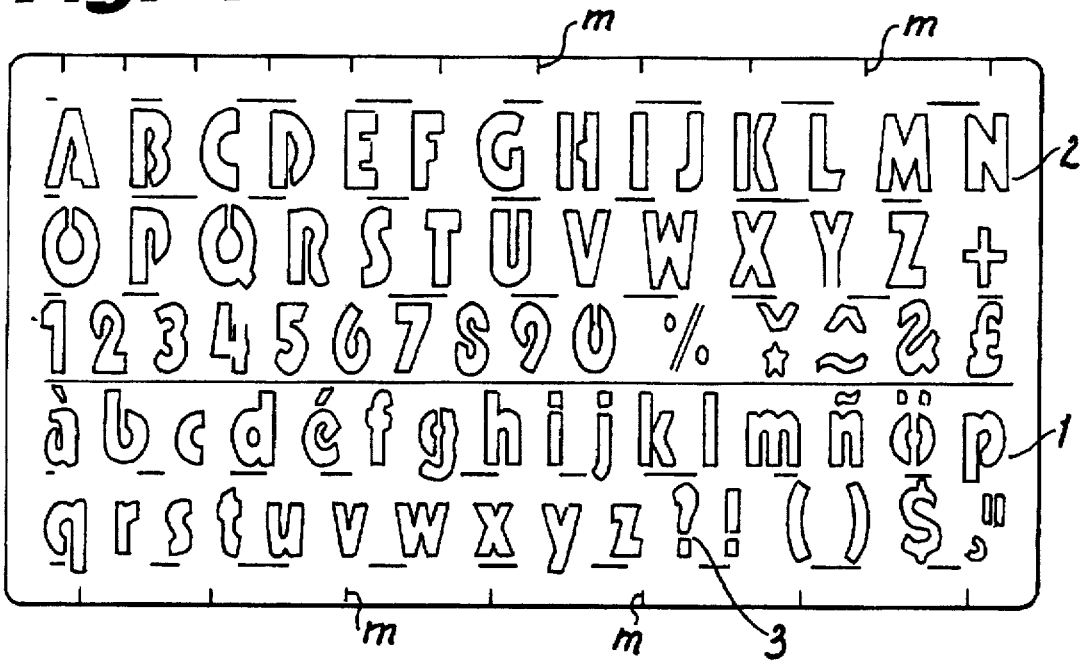
FIG. 4 shows a gauge according to the present invention.
Figure 6:
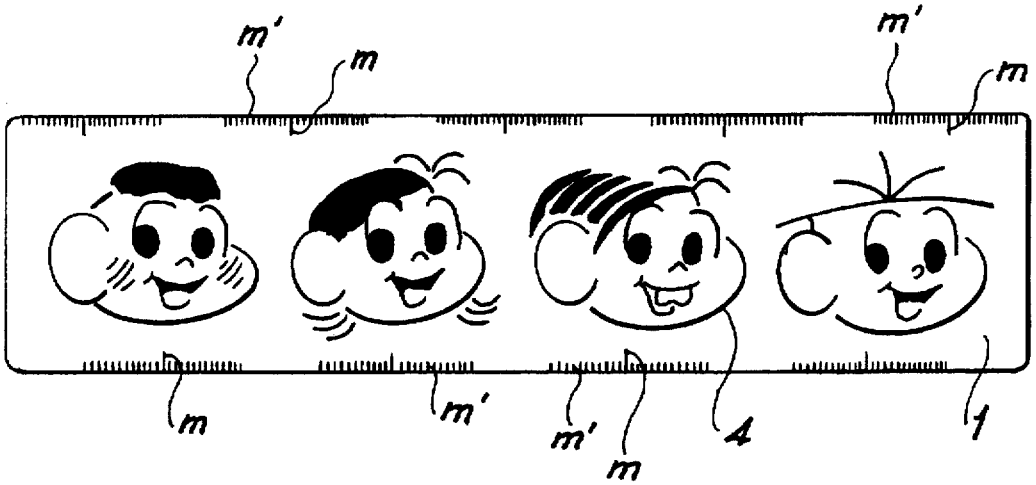
FIG. 6 illustrates another gauge produced according to of the present invention.

FIGS. 4 and 6 show two examples of gauges used for preparing drawings to be viewed a virtual way, according to the present invention. There is a base part (1), having any shape and preferably made of plastic or other appropriate material. On the base are stencil cutouts of letters (2) and/or graphic elements (3) and/or semi or totally pre-formed drawings (4). The contents are used as a guide and a pattern for the drawing reproduction of the letters, figures or graphics on a surface such as paper.

To allow a combination of drawings which can be seen as if they were on planes of different deepness (virtual image), the base part (1) has along one or more edges a scale with markings at progressively varying distances (m), such that the distance between points 0 and 1 is smaller than between points 1 and 2, this distance being smaller than between points 2 and 3, and so on. Seven such points, referred to as 0, 1, 2, 3, 4, 5, 6, are shown on the lower edge of the gauge. Any number of points can be used.

Along the top of the gauge there is another scale whose points are equidistant.

Based on said markings (m), it is possible to repeat the drawings (letters, characters, signs, figures, etc.) horizontally aligned with determined distances therebetween. This results in a deepness sensation when observed with vision focus out of (before or after) the surface where they are inscribed. When the focus of the viewer's eyes is located beyond the surface on which the drawings appear, the smaller the distance between the drawings the closer they will seem to be to the viewer. When the focus is formed behind the surface, the opposite occurs.

According to the pattern adopted in the gauge of the present invention, distances between drawings having a smaller value result in a closer proximity of the images.

The basic utilization method of the gauge according to the present invention is as follows:

(a) draw a horizontal straight line on a surface, such as a piece of paper, to serve as base for alignment;

(b) position the gauge so that the figure to be drawn is on the line and transfer it to (draw it on) the paper, marking a gauge distance point (for example, point 5 along the gauge bottom edge);

(c) slide the gauge to the right until the point marked coincides with the next, in this case, distance point 4 of the gauge;

(d) again draw the figure at the new position, repeat the operation of steps (b), (c) and (d) as many times as wished;

(e) if one keeps repeating the operation until the scale distance point 0 is reached, there will be six figures drawn, having distances that will decrease from left to right.

When observed with the focus behind the paper surface on which the figures are drawn, the right figures will seem to be closer and the left ones will seem progressively more distant.

In order to keep the viewed figures on the same plane, the figures are repeated on the paper with the same distance spacing between them. In this case, the equidistant point side on the gauge is used. Here, the drawing is made at a point is marked on the paper, the gauge is slid horizontally until the next point coincides with the marked one, the drawing is transferred to the new position, the first point is marked again and the operation is repeated as many times as wishes. The alignment is always kept horizontal for any new lines created.

As shown in FIG. 6, which is particularly useful in the case of drawing images of characters, besides the intervals (0–1; 1–2; 3–4; etc.), there is a scale of more closely spaced markings (m') on said base part (1). These serve as patterns for displacement of specific parts of the drawing, such as the eyes, nose, ears, etc. In this case, the user first draws the figure parts to be located on the same plane, marking the distances. After that, based on the smaller markings ($m^1$)the elements the user wishes to approach or move away are progressively displaced.

Figure 5:
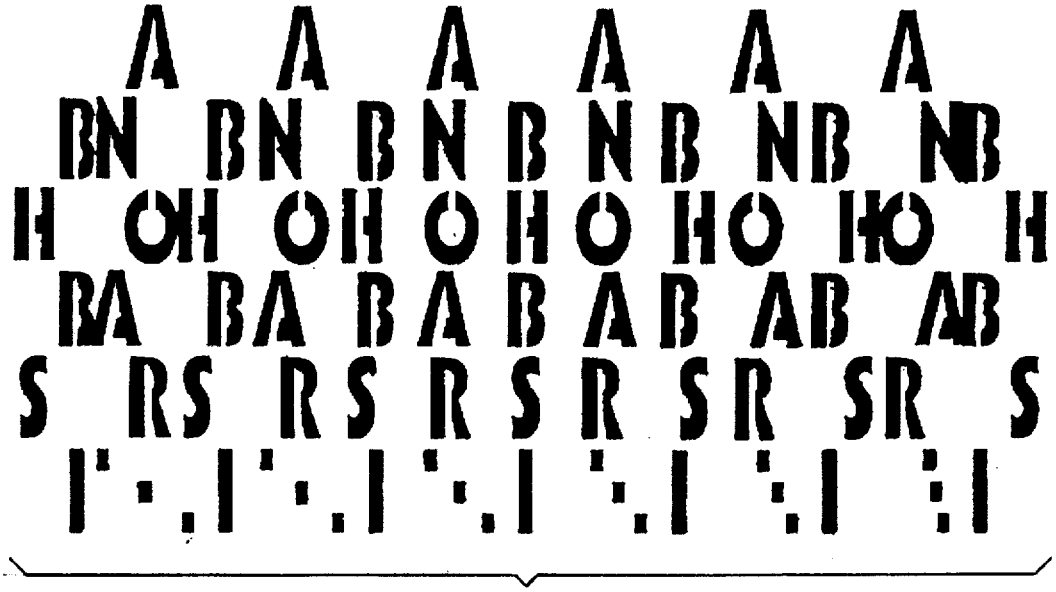
FIG. 5 shows a drawing prepared through the gauge of FIG. 4.
Figure 7:
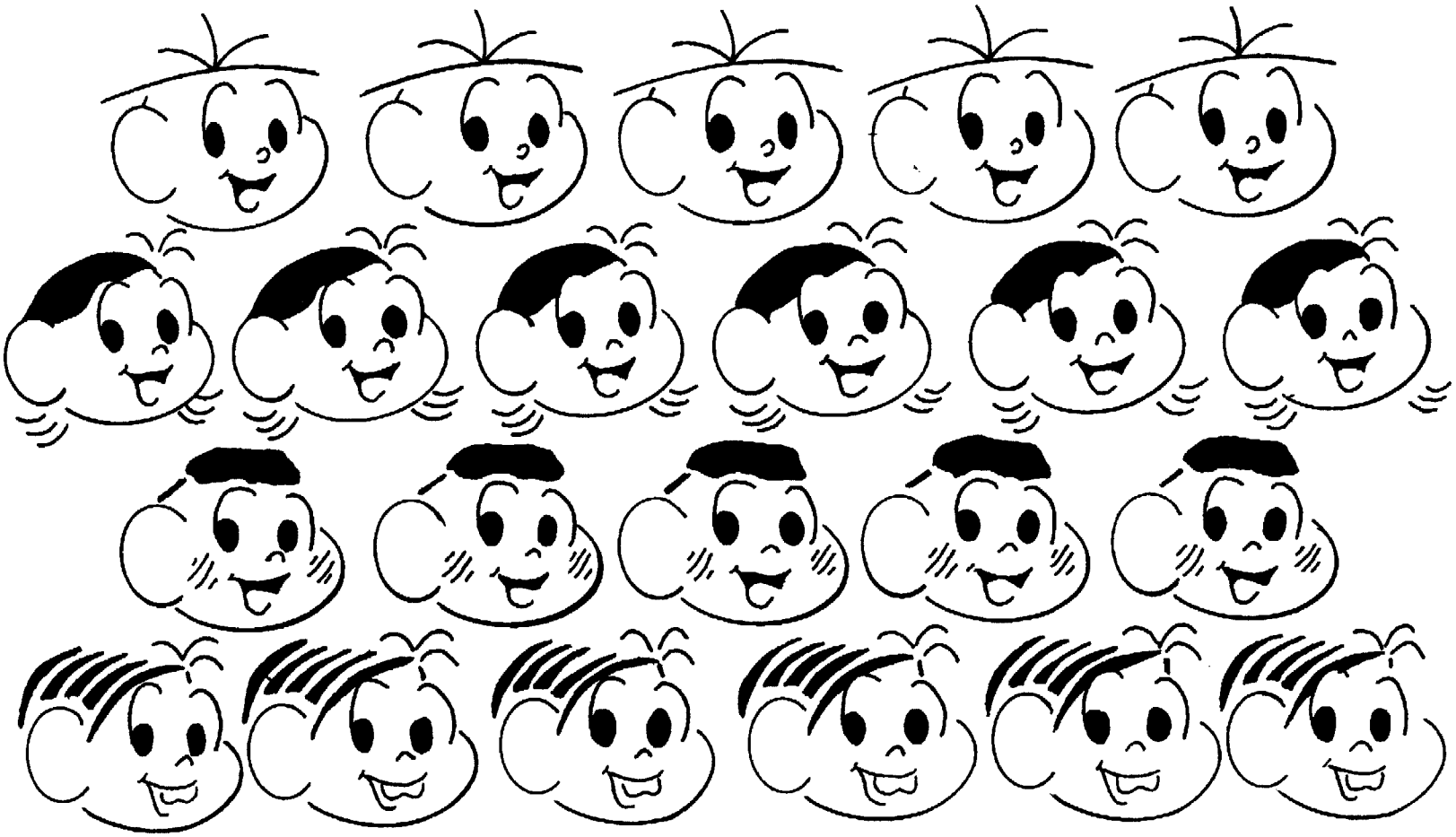
FIG. 7 illustrates a drawing prepared by using the gauge of FIG. 6.

Examples of drawings with virtual deepness effect achieved, which were produced by using the gauge of the present invention, containing letters, signs, digits and characters, are illustrated in FIGS. 5 and 7 and in the aforesaid related applications.

Figure 8:
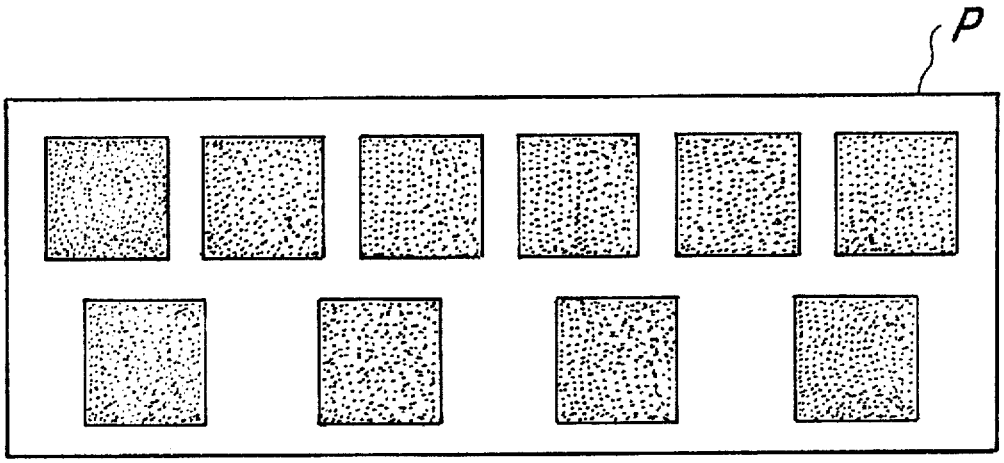
FIGS. 8 and 9 illustrate drawings prepared having different spacings between the figures.
Figure 9:
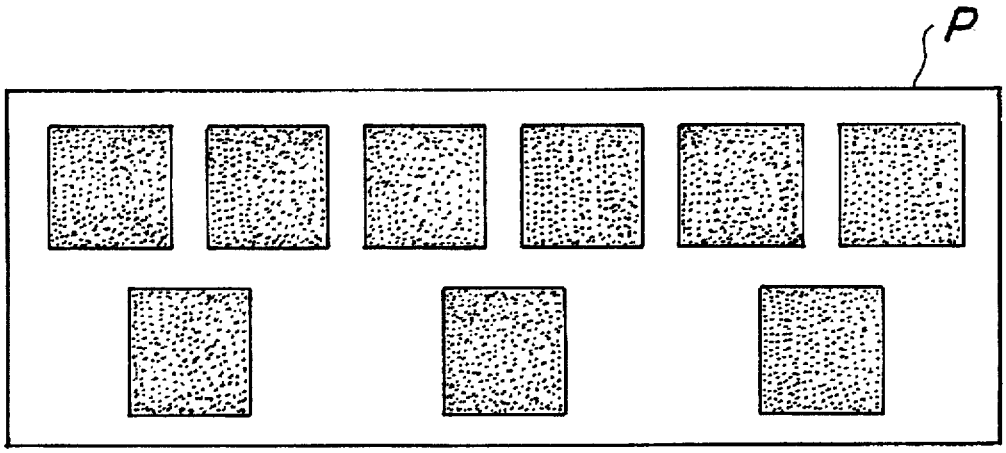

It should be understood that in scenes where equal figures are repeated, it is convenient to pay attention to the distances used. For example, a figure having a 15 mm width, repeated along a horizontal line at a distance of 20 mm, when close to the other line with the measurement pattern of 30 mm between the figures, as illustrated in FIG. 8, causes a specific deepness effect which is different from when it is close to another line where the measurement pattern is twice as great, 40 mm, as illustrated in FIG. 9. In this case, both lines of the drawings appear to be on the same plane. This difference occurs because the common focus possible between 20 mm and 30 mm occurs at a determined distance where the figures "unite" with the ones immediately beside, whereas, when the distances are 20 mm and 40 mm, in order to be focused, the figures having a distance of 20 mm "unite" alternatively, that is, at the same point as the 40 mm distances.

What is claimed is:

1. Gauge for preparation of drawings to be viewed with virtual deepness effect achievement, consisting essentially of:

a base part having stencil cutout elements of any one or combination of letters and/or graphic elements and/or semi or totally pre-formed drawings for drawing reproduction on a determined surface, and said base part having an elongated straight edge with a first scale therealong having markings of reference points with progressively decreasing distances therebetween to permit an element to be repetitively drawn along a line on a medium with progressively decreasing distances between elements corresponding to the progressively decreasing distances between the reference points of the first scale so as to produce a drawing, which can be viewed with virtual deepness.

2. Gauge according to claim 1, wherein said base part also has a second scale as part of said first scale with more closely spaced markings of progressively decreasing points of distance interpolated between said reference points of said first scale serving as a pattern for the displacement of specific parts of the drawing.

3. Gauge according to claim 1 wherein said base part also has an elongated straight edge with another scale with markings of reference points spaced equidistant from each other.

4. Method for using a gauge for preparation of drawings of an element with virtual deepness effect achievement, consisting essentially of the steps of:

providing a drawing surface;

providing a gauge base part having stencil cutout elements of any one or combination of letters and/or graphic elements and/or semi or totally pre-formed drawings for the drawing reproduction on a determine surface, and said base part having an elongated straight edge with a scale therealong having markings of reference points with progressively decreasing distances therebetween;

(a) drawing a horizontal straight line on said drawing surface to serve as a base for alignment;

(b) positioning the elongated straight edge of said gauge base part on said drawing surface straight line, drawing a said element from said gauge base part on said surface and marking a first distance point at which said element is drawn corresponding to one of said scale reference points;

(c) moving the gauge in one direction until the point marked coincides with the next reference point of the gauge to form a new distance point position;

(d) drawing the same element on the drawing surface at the new distance point position; and (e) repeating the operation of steps (b) through (d) as may times as desired so as to produce a drawing which can be viewed with virtual deepness.

* * * * *

UNITED STATES PATENT AND TRADEMARK OFFICE

CERTIFICATE OF CORRECTION

PATENT NO. : 5,687,488

DATED : November 18, 1997

INVENTOR(S) : Mauricio ARAÚJO DE SOUSA

It is certified that error appears in the above-identified patent and that said Letters Patent is hereby corrected as shown below:

On the title page: Item

[76], Inventor, change "Sãn Paulo" to --São Paulo--.

Signed and Sealed this

Twenty-eighth Day of April, 1998

Bruce Lehman

*Attest:*

BRUCE LEHMAN

*Commissioner of Patents and Trademarks*

*Attesting Officer*